United States Patent [19]

Taki et al.

[11] Patent Number: 4,906,142

[45] Date of Patent: Mar. 6, 1990

[54] SIDE CUTTING BLADES FOR MULTI-SHAFT AUGER SYSTEM AND IMPROVED SOIL MIXING WALL FORMATION PROCESS

[75] Inventors: Osamu Taki, Belmont; Shigeru Takeshima, San Mateo, both of Calif.

[73] Assignee: S.M.W. Seiko, Inc., Redwood City, Calif.

[21] Appl. No.: 389,546

[22] Filed: Aug. 2, 1989

Related U.S. Application Data

[62] Division of Ser. No. 172,401, Mar. 23, 1988.

[51] Int. Cl.[4] ..... E02D 17/13; E02D 5/18

[52] U.S. Cl. ..... 405/267; 405/241; 405/269; 405/233

[58] Field of Search ..... 405/267, 266, 258, 263, 405/269, 232, 231, 233, 239, 240, 241

[56] References Cited

U.S. PATENT DOCUMENTS

| | | | |
|---|---|---|---|
| 2,048,710 | 7/1936 | Ranney | 405/267 |
| 2,950,902 | 8/1960 | Olds | 175/323 X |
| 3,023,585 | 3/1962 | Livey | 405/269 X |
| 3,139,729 | 7/1964 | Miotti | 405/267 |
| 3,422,913 | 1/1969 | Young | 175/323 X |
| 4,036,529 | 7/1977 | Hawthorne et al. | 175/323 X |
| 4,043,909 | 8/1977 | Endo et al. | 210/49 |
| 4,063,424 | 12/1977 | Takagi et al. . | |
| 4,065,928 | 1/1978 | Takagi et al. . | |
| 4,065,933 | 1/1978 | Katayama . | |
| 4,069,678 | 1/1978 | Miura et al. . | |
| 4,084,383 | 4/1978 | Kukino et al. . | |
| 4,089,183 | 5/1978 | Endo et al. . | |
| 4,189,239 | 2/1980 | Miyaguchi et al. | 366/169 |
| 4,212,548 | 7/1980 | Miyaguchi et al. | 366/348 |
| 4,402,630 | 10/1983 | Miura et al. | 405/266 |
| 4,436,453 | 3/1984 | Miura et al. | 405/263 |
| 4,449,856 | 5/1984 | Tokoro et al. | 405/269 |
| 4,475,847 | 10/1984 | Cornely et al. | 405/264 |
| 4,662,792 | 5/1987 | Gessay | 405/233 |

FOREIGN PATENT DOCUMENTS

| | | |
|---|---|---|
| 51-71605 | 6/1976 | Japan . |
| 52-78302 | 6/1977 | Japan . |
| 52-152608 | 12/1977 | Japan . |
| 55-44812 | 11/1980 | Japan . |
| 58-29374 | 6/1983 | Japan . |
| 58-29375 | 6/1983 | Japan . |

OTHER PUBLICATIONS

"S.M.W. Machine," Product Brochure of S.M.W. Seiko, Inc.

"Teno Column Method" Product Brochure of the Tenox Corporation (publication date unknown).

"Just One of Our Fleet," Product Advertisement (publication date unknown).

"The Soil Mixing Wall (SMW Technique)–Guidelines for its Design and Implementation," Japanese Materials Institute.

"In Situ Soil Improvement Techniques", Lime Columns (dated Mar. 1987).

Jasperse and Ryan, "Geotech Import: Deep Soil Mixing," Civil Engineering (Dec. 1987), pp. 66–68.

*Primary Examiner*—Dennis L. Taylor

*Attorney, Agent, or Firm*—Workman, Nydegger & Jensen

[57] ABSTRACT

The present invention is directed to side cutting blades for use with multi-shaft auger machines which mix soil with a chemical hardener in situ to form soilcrete columns. The side cutting blades includes two parallel blades which cut the soil between the adjacent columns along planes approximately tangential to the periphery of adjacent columns. As the soil is cut by the cutting blades, the soil is thoroughly mixed with a chemical hardening agent. Adjacent soilcrete columns are integrally connected by substantial column overlap without physically moving the columns closer together or performing multiple borings on the soil adjacent to the columns formed by the initial boring.

The side cutting blades are particularly suited for use with a multi-shaft auger machine which has minimal column overlap. A multi-shaft auger machine equipped with side cutting blades may be used to construct continuous in situ wall formations which are homogeneous in composition and have a minimum thickness approximately equal to the diameter of the auger shafts.

32 Claims, 7 Drawing Sheets

SIDE CUTTING BLADES FOR MULTI-SHAFT AUGER SYSTEM AND IMPROVED SOIL MIXING WALL FORMATION PROCESS

BACKGROUND

This application is a divisional of application Ser. No. 07/172,401, filed Mar. 23, 1988.

1. The Field of the Invention

The present invention relates to multi-shaft auger systems and processes for mixing soil with a chemical hardener in situ in order to form soilcrete columns, walls, and piles. More particularly, the present invention permits improved soil/hardener mixing over a larger area in less time than the prior art soil mixing techniques.

2. The Prior Art

For a number of years, multi-shaft auger machines have been used in Japan to construct concrete-like columns in the ground without having to excavate the soil. These columns are sometimes referred to as "soilcrete" columns, because the soil is mixed with a cement hardener in situ. Upon hardening, the soilcrete columns possess characteristics of concrete columns, but they are constructed without the expense and time-consuming processes of removing and replacing the soil with concrete.

The soilcrete columns have been arranged in a variety of patterns depending on the desired application. Soilcrete columns are used to improve the load bearing capacity of soft soils, such as sandy or soft clay soils. The columns are formed deep in the ground and form a solid base or "foundation" for anchoring or supporting surface construction on such soft soils.

In other cases, the soilcrete columns have been overlapped to form boundary walls, structural retaining walls, low to medium capacity soil-mixed caissons, and piles which act as a base for construction.

To produce soilcrete columns, a multi-shaft auger machine bores holes in the ground and simultaneously mixes the soil with a chemical hardening material pumped from the surface through the auger shaft to the end of the auger. Multiple columns are prepared while the soil-cement mixture is still soft to form continuous walls or geometric patterns within the soil depending on the purpose of the soilcrete columns.

Because the soil is mixed in situ and because the soilcrete wall is formed in a single process step, the construction period is shorter than for other construction methods. Obviously, the costs of forming soilcrete columns are less than traditional methods requiring excavation of the soil in order to form concrete pillars or walls. In addition, because the soil is not removed from the ground, there is comparatively little material produced by such in situ processes that must be disposed of during the course of construction.

Historically, a modified earth digging auger machine is used in the formation of in situ soilcrete columns. The boring and mixing operations are performed by multi-shaft drive units in order to make the process more efficient. The shafts typically contain soil mixing paddles and augers which horizontally and vertically mix the soil with the hardening material, thereby producing a column having a homogeneous mixture of the soil and the hardener.

As ground penetration occurs, the chemical hardener slurry is injected into the soil through the end of the hollow stemmed augers. The augers penetrate and break loose the soil and lift the soil to mixing paddles which blend the slurry and the soil. As the auger continues to advance downwardly through the soil, the soil and slurry are remixed by additional augers and paddles attached to the shaft.

Two-shaft and three-shaft auger machines have been used to construct soilcrete columns. Three-shaft machines were first developed for constructing continuous wall structures, such as diaphragm walls and retaining walls. The three shafts mutually overlap so that each individual shaft produces a column which is physically linked and overlapped with the adjacent columns. The net result is a homogeneous and continuous soilcrete wall. However, the amount of overlap is limited in order to avoid interference between adjacent augers.

Unfortunately, three-shaft auger machines require a tremendous amount of power to drive each shaft. It will be appreciated that individual shaft power requirements are proportional to the cross-sectional area of the column. Thus, as the column column radius increases, the shaft's power requirements increase by an amount proportional to the square of the radius increase. As a result, three-shaft auger machines have not been particularly successful in constructing large diameter continuous walls.

Auger machines with more than three shafts have also been used in Japan to construct continuous walls in situ, but the walls were relatively thin compared to those constructed with a typical three-shaft auger machine. Generally, as the number of shafts to be driven increases, the auger diameter of each shaft decreases.

It has been found that a two-shaft auger machine can produce larger diameter columns with less power than a three-shaft machine. Furthermore, if the total power previously used to drive three shafts is applied to drive just two shafts, a larger diameter column may be produced in unusually hard and/or rocky soil. Therefore, two-shaft auger machines have been used to produce larger diameter columns than a three-shaft machine. Nevertheless, while a two-shaft machine can produce such columns in harder soil and yet consume less power than a three-shaft auger machine, the efficiency of the overall process is less because substantially more strokes up and down through the soil are necessary in order to construct a wall of a given length.

In actual use, the prior art has used the two-shaft auger machine such that each borehole is "double bored" in order to insure that adjacent columns overlap and are continuous. While this produces a very homogeneous soilcrete structure, it is very time consuming and uses more of the chemical hardener.

The alternative is to use a three-shaft auger machine, but this results in a wall having weak areas because the soil/hardener mixture may not be homogeneously mixed. In order to assure a homogeneous mixture within each column and so that adjacent columns are substantially comparable in strength, density, and integrity, each column would have to be "triple bored," which is an uneconomical process.

Despite its apparent advantages, the two-shaft auger machine does possess some disadvantages. As mentioned above, the two-shaft auger machine is less economical in use because it takes longer to form a column or wall over a given area vis-a-vis using a three-shaft auger machine. Moreover, the two-shaft auger machine can result in the use of more chemical hardener than a three-shaft auger machine. Since material costs are a significant portion of the total costs of the prior art processes, this further makes the two-shaft auger machine less economical to use.

Moreover, due to mechanical limitations, it has been found that a two-shaft auger machine cannot have the same degree of shaft overlap as a three-shaft machine. In fact, the shaft overlap on a two-shaft machine is so slight that the two shaft machine forms in situ columns essentially tangent to each adjacent column. As a result, a two-shaft auger machine is not particularly useful for preparing continuous wall formations which are to function as a boundary or cut off wall.

Thus, two-shaft auger machines have been most useful in the prior art in soil or foundation improvement projects where longitudinal support is needed. For instance, the columns are arranged in various geometric patterns such as triangles, squares, or hexagons to improve the load-bearing capacity of the soil.

A two-shaft auger machine has also been used on other large scale soil improvement projects. For example, continuous, large-area columns may be constructed by overlapping and offsetting individual soilcrete columns. However, because a two-shaft auger machine does not create columns with substantial overlap, numerous voids or interstitial spaces of unmixed soil are formed when a two-shaft auger machine is used to construct large-area solid columns.

These voids and interstitial spaces have been eliminated only through extensive overlap and offset of the soilcrete columns or through additional boring if no offset or overlap is used. However, such procedures result in increased time and expense which are important factors in any construction project.

From the foregoing, it will be appreciated that what is needed in the art are apparatus and methods for forming soilcrete columns, walls, and piles which permit increased effective overlap between adjacent columns without sacrificing column diameter or requiring larger power equipment.

It would be another advancement in the art to provide apparatus and methods for forming larger soilcrete columns with an effective overlap between the columns which may be constructed in series in order to form continuous soilcrete walls or piles.

It would be a further advancement in the art to provide apparatus and methods for forming soilcrete columns, walls, and piles with increased effective overlap between adjacent columns in order to provide improved soil stabilization or foundational support capabilities.

Additionally, it would be a significant advancement in the art to provide apparatus and methods for forming soilcrete columns, walls, and piles which permit efficient construction of continuous large-area columns without creating interstitial voids and without requiring substantial column overlap and offset.

It would be yet another advancement in the art to provide apparatus and methods for forming soilcrete columns, walls, and piles which minimize the amount of chemical hardener required, thereby reducing construction costs.

It would be a further advancement in the art to provide apparatus and methods for forming soilcrete columns, walls, and piles which require fewer penetrating strokes than conventional apparatus and methods, thereby providing increased construction time efficiency.

It would be an additional advancement in the art to provide apparatus and methods for forming soilcrete columns, walls, and piles with increased verstility, wherein the same equipment may be used to construct different types of walls, columns, and piles.

It would be another advancement in the art to provide apparatus and methods for forming soilcrete columns, walls, and piles which have a homogeneous blend of soil and chemical hardener without increasing the construction time, the overall cost, and the amount of materials consumed.

It would be a further advancement in the art to provide apparatus and methods for forming soilcrete columns, walls, and piles wherein adjacent columns possess substantially equal strength, density, and integrity properties.

The foregoing, and other features and objects of the present invention are realized in the improved multi-shaft auger apparatus and methods which are disclosed and claimed herein.

BRIEF SUMMARY AND OBJECTS OF THE INVENTION

The present invention is directed to side cutting blades for use wih multi-shaft auger machines which construct in situ soilcrete columns. The side cutting blades include two parallel blades which cut the soil between the adjacent columns along planes approximately tangential to the periphery of adjacent columns. As the soil is cut by the cutting blades, the soil is thoroughly mixed with the chemical hardening agent (sometimes referred to as "cement milk") and with the soil from the adjacent columns. In this way, adjacent soilcrete columns are integrally connected by substantial column overlap without physically moving the columns closer together or performing multiple borings on the soil adjacent to the two columns formed by the initial boring.

The side cutting blades are secured to nonrotating bands around the adjacent shafts. Proper column spacing and alignment and stability to the side cutting blades are provided by a stabilizing bar securely positioned between the nonrotating bands. Each of the cutting blades contains a cutting edge which cuts a section of the soil between the adjacent augers as the augers penetrate downwardly through the soil. The precise shape of the cutting blades may be modified depending on the soil conditions.

The side cutting blades of the present invention are particularly suited for use with a two-shaft auger machine which has minimal column overlap. When used on a two-shaft auger machine, the efficiency of the machine is greatly increased by the side cutting blades. Moreover, a two-shaft auger machine equipped with side cutting blades may be used to construct continuous soilcrete walls which are homogeneous in composition and minimize weak portions between the adjacent columns forming the soilcrete walls.

In the construction of continuous soilcrete walls according to the present invention, a two-shaft auger machine having a first auger and a second auger is used to penetrate downwardly through the ground and to mix a "cement milk" slurry with the soil. The first and second augers form a first soilcrete column and a second soilcrete column, respectively.

As the augers penetrate downwardly through the soil, the side cutting blades cut the soil between the adjacent soilcrete columns along planes approximately tangential to the periphery of adjacent columns. The soil cut by the side cutting blades is thoroughly mixed with the soil from the adjacent columns and with the cement milk. As a result, adjacent columns enjoy the benefits of substantial column overlap without actually moving the columns closer together or performing an additional boring on the soil between the adjacent columns.

After the augers are withdrawn from the soil, the auger machine is advanced horizontally such that the first auger is positioned adjacent to the recently formed second column.

Two additional soilcrete columns are formed as described above, and the augers are withdrawn from the soil. The auger machine is then moved back such that the first auger is positioned over the previously formed second column and the second auger is positioned over the recently formed first column. As the augers penetrate the ground, the soil is thoroughly blended with the chemical hardener and each of the previously formed columns is linked to form a continuous soilcrete wall. The above process is repeated until the desired wall formation is complete.

Soilcrete wall formations may alternatively be constructed by advancing the auger machine horizontally such that the first auger is positioned over the previously formed second column. As the augers penetrate the ground again, the previously formed second column serves as a guide hole for the first auger. In this way, the soil and cement mixture in the previously formed second column is thoroughly mixed and the newly formed second column is continuous with the previously formed columns. The process is then repeated until the soilcrete wall is completed.

A two-shaft auger machine properly fitted with side cutting blades may also be used to construct improved soil stabilization and foundational support structures. In addition, a two-shaft auger machine fitted with side cutting blades is ideally suited for constructing continuous large-area columns or piles. Such continuous large-area columns may be constructed by combining a series of continuous parallel wall formations. The side cutting blades permit the continuous wall formations to be combined with minimal overlap and offset of the adjacent soilcrete walls. As a result, large volume columns may be constructed without forming voids or interstitial spaces of unmixed soil between the individual soilcrete columns which form the continuous walls.

It is, therefore, an object of the present invention to provide apparatus and methods for forming soilcrete columns, walls, and piles which permit increased effective overlap between adjacent columns without sacrificing column diameter or requiring larger power equipment. Another important object of the present invention is to improve soil-hardener mixing over a larger area and in less time than known soil-mixing techniques.

An additional important object of the present invention is to provide an apparatus and method for forming larger soilcrete columns with an effective overlap between the columns which may constructed in series to form continuous soilcrete walls or piles.

Still another object of the present invention is to provide an apparatus and method for forming soilcrete columns, walls, and piles with increased effective overlap between adjacent columns in order to provide improved soil stabilization and foundational support capabilities.

Yet another object of the present invention is to provide an apparatus and method for forming soilcrete columns, walls, and piles which permit efficient construction of solid large-volume columns without creating interstitial voids and without requiring substantial column overlap and offset.

A further important object of the present invention is to provide apparatus and methods for forming soilcrete columns, walls, and piles which minimize the amount of chemical hardener required, thereby reducing construction costs.

Another object of the present invention is to provide apparatus and methods for forming soilcrete columns, walls, and piles which require fewer penetrating strokes than conventional apparatus and methods, thereby providing increased construction time efficiency.

An additional important object of the present invention is to provide apparatus and methods for forming soilcrete columns, walls, and piles with increased versatility, wherein the same equipment may be used to construct different types of walls, columns, and piles.

Still another object of the present invention is to provide apparatus and methods for forming soilcrete columns, walls, and piles possessing a homogeneous blend of soil and chemical hardener without increasing the construction time, the overall cost, and the amount of materials consumed.

Yet another object of the present invention is to provide apparatus and methods for forming soilcrete columns, walls, and piles wherein adjacent columns possess substantially equal strength, density, and integrity properties.

These and other objects and features of the present invention will become more fully apparent from the following description and appended claims taken in conjunction with the accompanying drawings.

DETAILED DESCRIPTION OF THE PREFERRED EMBODIMENTS

Figure 1:
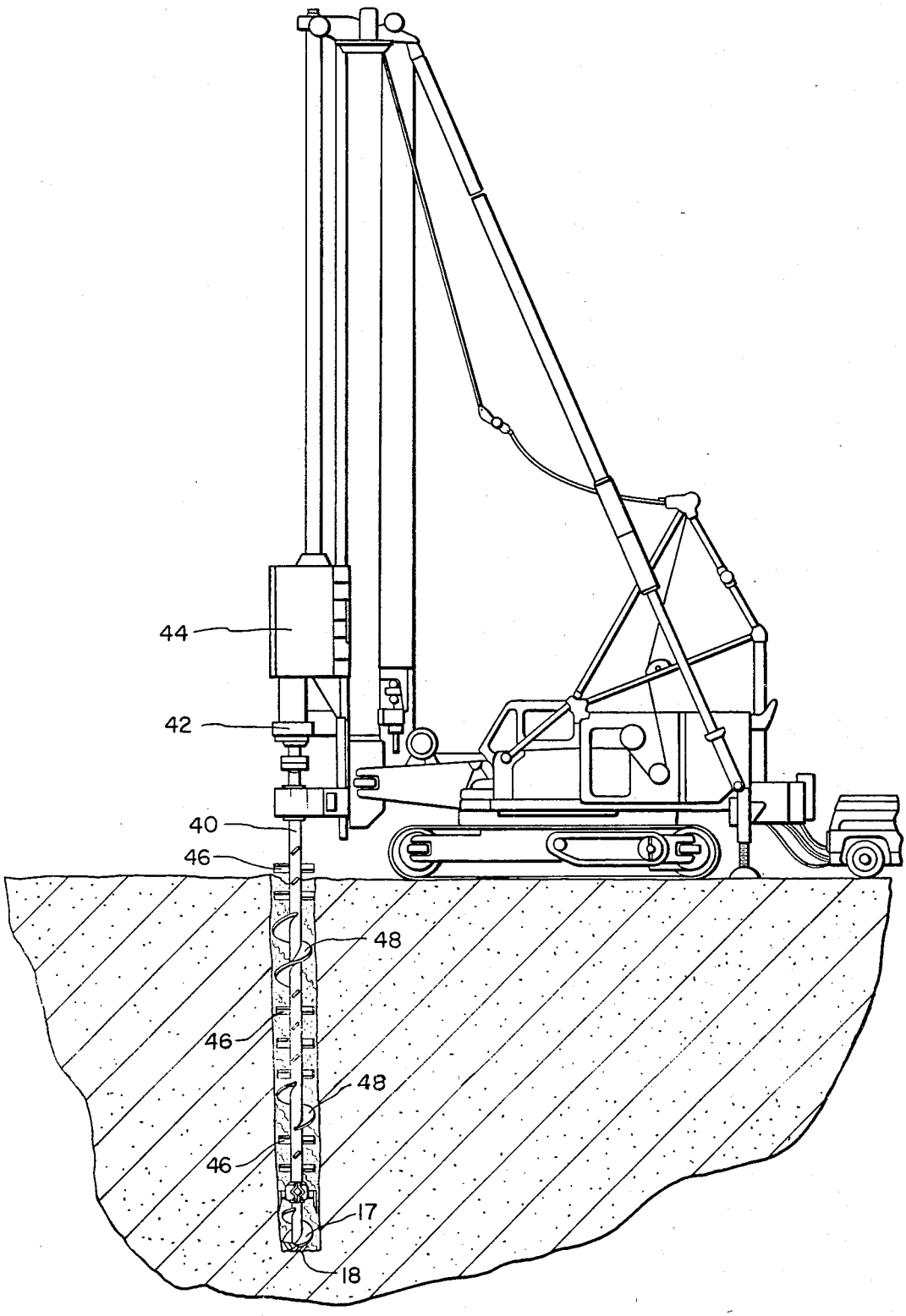
FIG. 1 is a plan view of one presently preferred embodiment within the scope of the present invention as it would appear in operation.

Reference is now made to the drawings wherein like parts are designated with like numerals throughout. Referring initially to FIG. 1, one presently preferred embodiment within the scope of the present invention is illustrated in connection with a multi-shaft auger machine as the machine would appear in operation.

In FIG. 1, each shaft of the multi-shaft auger machine, shown generically as shaft 40, is attached to a gearbox 42 at the upper end of the shaft. A motor 44 transfers power through the gear box to the shafts. Spaced throughout the length of each shaft are intermittent soil mixing paddles 46 and auger blades 16 and 17. The intermittent auger blades breakup the soil and vertically mix the soil with a chemical hardener which is injected into the soil surrounding the shafts. The soil mixing paddles further assist to breakup the soil and horizontally mix the soil with the chemical hardener.

Figure 2:
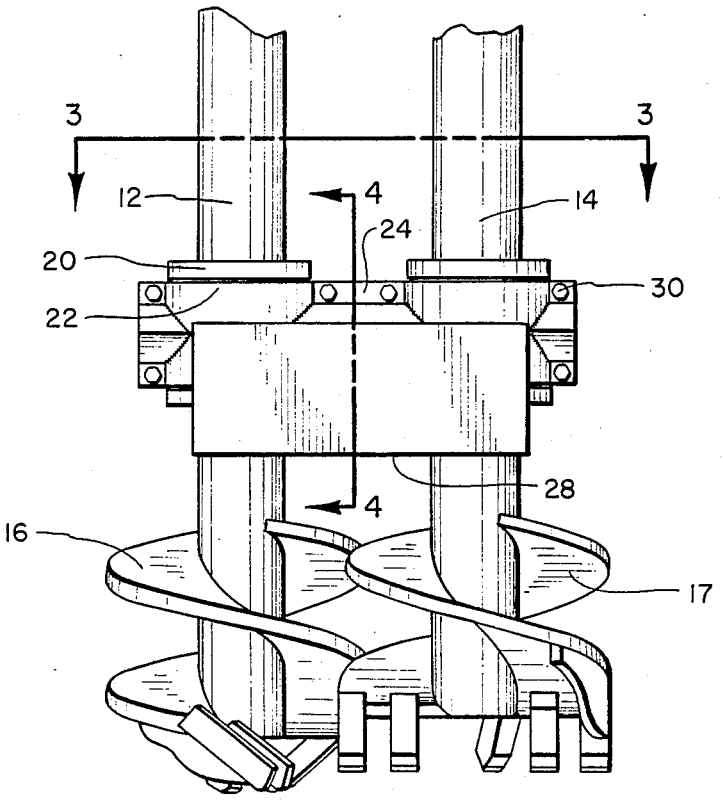
FIG. 2 is a plan view of an embodiment within the scope of the present invention showing a two-shaft auger with auger blades and a side cutter.
Figure 3:
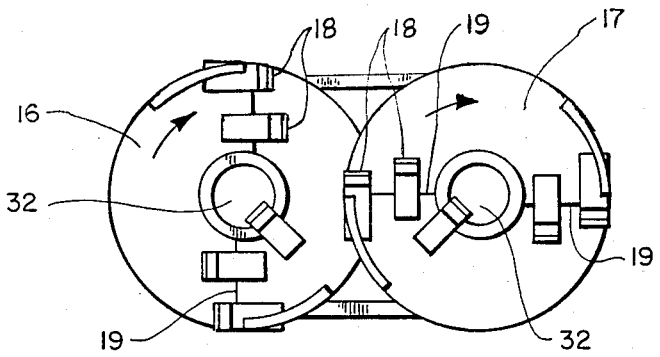
FIG. 3 is a bottom plan view of the embodiment of the present invention illustrated in FIG. 2.

FIG. 2 illustrates the details of a two-shaft auger machine within the scope of the present invention. The auger machine contains a first shaft 12 and a second shaft 14. Attached to the end of first shaft 12 and second shaft 14 are first auger blade 16 and second auger blade 17, respectively. As illustrated in FIG. 3, the first and second auger blades each possess an auger cutting edge 19 which cuts into the soil at the bottom of each borehole. Auger teeth 18 are preferably secured to the cutting edge of the first and second auger blades in order to assist in soil penetration in clay or rocky soils.

Both the first shaft and the second shaft have a pair of cylindrical collars 20 spaced apart and formed around the periphery of each shaft. Collars 20 rotate with the shaft. Nonrotating bands 22 surround each shaft and are positioned between the cylindrical collars on each shaft. The collars prevent the nonrotating bands from shifting vertically along the length of each shaft. Conventional bearing means (not shown) allows the shaft to rotate within the nonrotating bands.

A stabilizer bar 24 is securely attached to the nonrotating bands to maintain proper shaft spacing and alignment and to provide additional support for the side cutting blades, as discussed hereinafter. While nonrotating bands 22 and stabilizer bar 24 are illustrated as separate elements, it will be appreciated that they may be constructed of a single unitary piece. In addition, the bands and stabilizer bar may be constructed to be removable for easy assembly and disassembly of the shafts of the auger machine and for easy repair and replacement of the side cutting blades. As is more clearly illustrated in FIGS. 4 and 5, the band and stabilizer will, in practice, be constructed in two pieces which are bolted together with bolts 30.

Attached to each of the nonrotating bands are parallel cutting blades 26. As shown in FIG. 3, cutting blades 26 are positioned so as to be approximately tangent to the periphery of the circles formed by first auger blade 16 and second auger blade 17. Each of these cutting blades has a cutting edge 28.

Figure 4:
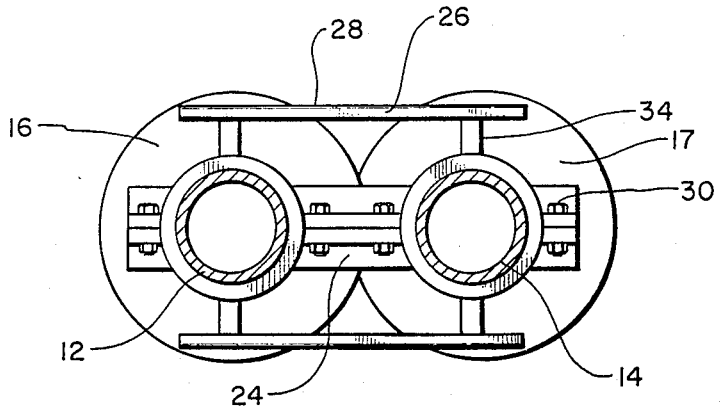
FIG. 4 is a cross-sectional view of the embodiment of the present invention illustrated in FIG. 2 taken along line 4—4 of FIG. 2.
Figure 5:
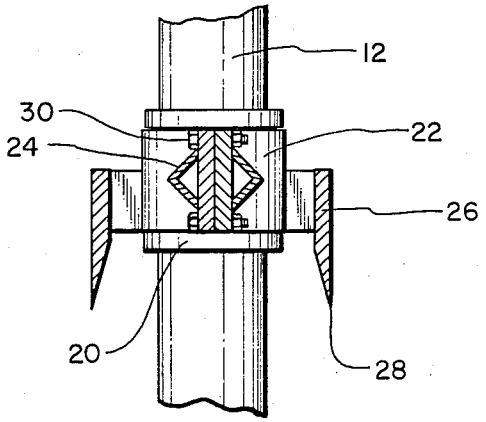
FIG. 5 is a cross-sectional view of the embodiment of the present invention illustrated in FIG. 2 taken along line 5—5 of FIG. 2.

Clearly illustrated in FIGS. 4 and 5, cutting edges 28 are located on the lowermost outer edges of parallel cutting blades 26. The specific configuration of the cutting edges is not critical, provided that the edge is sufficiently sharp or configured to be capable of penetration through the soil as the shafts and augers move downwardly through the soil.

Figure 9:
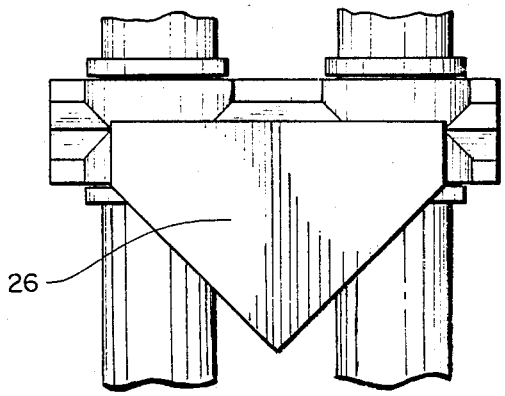
FIG. 9 is a plan view of another embodiment within the scope of the present invention illustrating a cutting blade having a "V" shape.
Figure 10:
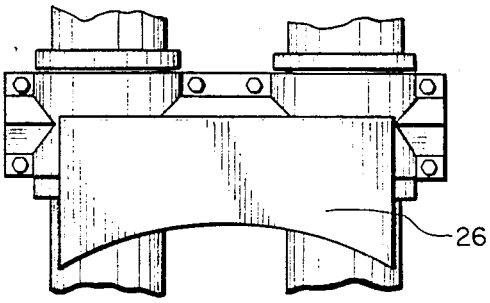
FIG. 10 is a plan view of another embodiment within the scope of the present invention illustrating a cutting blade having a concave shape.
Figure 11:
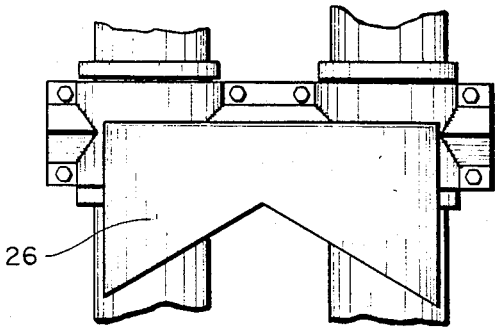
FIG. 11 is a plan view of another embodiment within the scope of the present invention illustrating a cutting blade having an inverted "V" shape.

As shown in FIGS. 9, 10, and 11, cutting blades 26 may be configured in various geometric forms. For example, in FIG. 9 the cutting blades are in a "V" shape, in FIG. 10 the cutting blades are in a concave shape, and in FIG. 11 the cutting blades are shown in an inverted "V" shape. The configuration of the cutting blades illustrated in FIG. 5 will be satisfactory for most circumstances; however, an alternative configuration may be desirable depending upon the specific soil conditions to allow for better penetration. It will be appreciated that cutting edge 28 may be configured in other geometric shapes which are not illustrated.

Referring now to FIG. 3, the bottom end of both first shaft 12 and second shaft 14 contain discharge openings 32 from which a chemical hardener is discharged. As discussed in greater detail hereinafter, this chemical hardener will typically include cement milk, bentonite, asphalt and/or other hardeners or aggregates. It is from openings 32 that the chemical hardener (hereinafter sometimes referred to generically as "cement milk") is released into the soil to be mixed by the intermittent auger blades and soil mixing paddles along the length of the first and second shafts in order to form a generally homogenous mixture.

The resulting mixture of soil and chemical hardener is sometimes referred to as "soilcrete" because the hardener mixture often possesses physical properties similar to concrete. Nevertheless, use of the term "soilcrete"

does not mean that soil is mixed with concrete or that the chemical hardener contains cement.

FIG. 3 also illustrates the amount of overlap typically between first auger blade 16 and second auger blade 17. It will be appreciated that the amount of overlap between two adjacent circles may be measured in two ways: first by measuring the overlap along the line formed between the center of each circle (hereinafter referred to as linear overlap); second by measuring the thickness of the overlap in relation to the diameter of the circles (hereinafter referred to generally as overlap). The amount of overlap in a two-shaft auger system compared to the auger diameter is typically less than about 1:10, preferably only about 1:20. Thus, if the auger diameter is 1000 millimeters then the thickness at the point of overlap will usually be only about 50–100 millimeters. The amount of overlap is also shown in FIG. 6, which illustrates the cross-sectional configuration of columns produced by a two-shaft auger machine without side cutting blades.

As shown in FIGS. 4 and 5, each of the cutting blades is attached to the nonrotating bands with arms 34. Arms 34 may be lengthened or shortened depending on the desired separation distance between parallel cutting blades 26.

Preferably the cutting blades would be positioned so that cutting edges 28 are tangential with the periphery of the circles formed by the first and second auger blades. However, in practice, the cutting blades are typically positioned slightly within the lines tangent to the periphery of the circles formed by the first and second auger blades. Thus, the cutting blades are positioned by arms 34 such that the maximum distance between them is approximately equal to the diameter of the auger blades.

Figure 6:
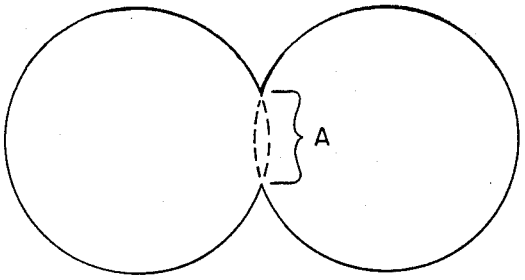
FIG. 6 is a view illustrating the cross-sectional configuration of columns produced by a two-shaft auger machine without side cutting blades.
Figure 7:
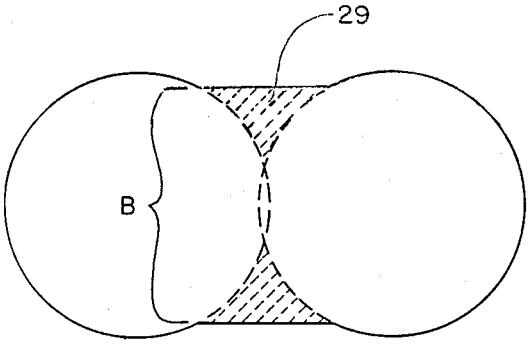
FIG. 7 is a view illustrating the cross-sectional configuration of columns produced by a two-shaft auger machine using side cutting blades within the scope of the present invention.

FIGS. 6 and 7 respectively illustrate the cross-sectional configuration of columns produced by a two-shaft auger machine without and with the parallel side cutting blades. It is apparent that the use of side cutting blades creates the effect of substantial column overlap without physically moving the augers closer together during the boring process.

FIG. 6 specifically shows the typical amount of overlap A achieved with a two-shaft auger machine without using the side cutting blades. As shown in FIG. 7, the effective overlap B achieved with the use of side cutting blades is substantially greater than the overlap A of FIG. 6. FIG. 7 also illustrates soil 29 located between the cutting blades which is cut and mixed with the chemical hardener.

Figure 8:
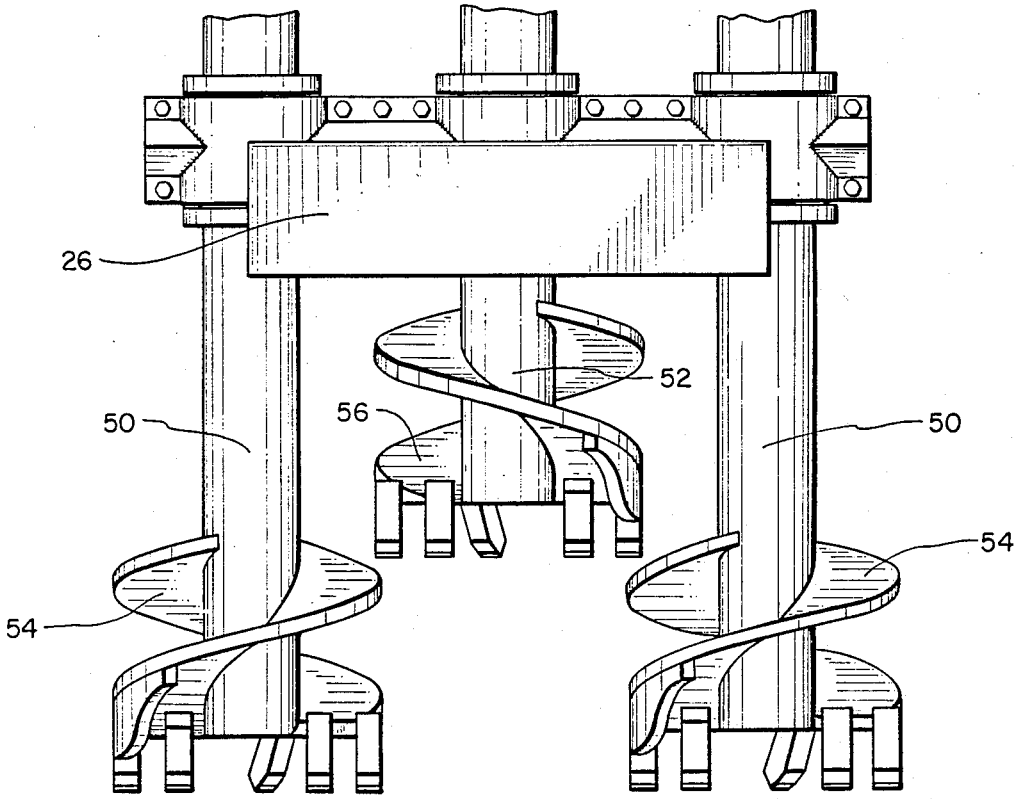
FIG. 8 is a plan view of another presently preferred embodiment within the scope of the present invention attached to a three-shaft auger machine.

Referring now to FIG. 8, an embodiment within the scope of the present invention used in connection with a three-shaft auger machine is illustrated. Although the inherent structure of a three-shaft auger machine provides for substantial column overlap, side cutting blades on a three-shaft auger machine create the effect of even greater column overlap without having to alter the physical relationship of the augers and shafts. The side cutting blades are attached to a three-shaft auger machine in substantially the same manner as described above with respect to a two-shaft auger machine.

The three-shaft auger machine contains two outside shafts 50 and a center shaft 52. The substantial column overlap associated with the three-shaft auger machine exists because auger blades 54 attached to outer shafts 50 are vertically offset from auger blade 56 attached to inner shaft 52. Because the auger blades are offset, the shafts are positioned closer together thereby increasing the column overlap.

Generally, each shaft on a multi-shaft auger machine with three shafts or more rotates in a direction opposite the rotation of adjacent shafts. As shown in FIG. 8, the auger blade attached to inner shaft 52 has a spiral configuration opposite the auger blades attached to outer shafts 50. Thus, inner shaft 52 rotates in a direction opposite outer shafts 54.

Figure 12:
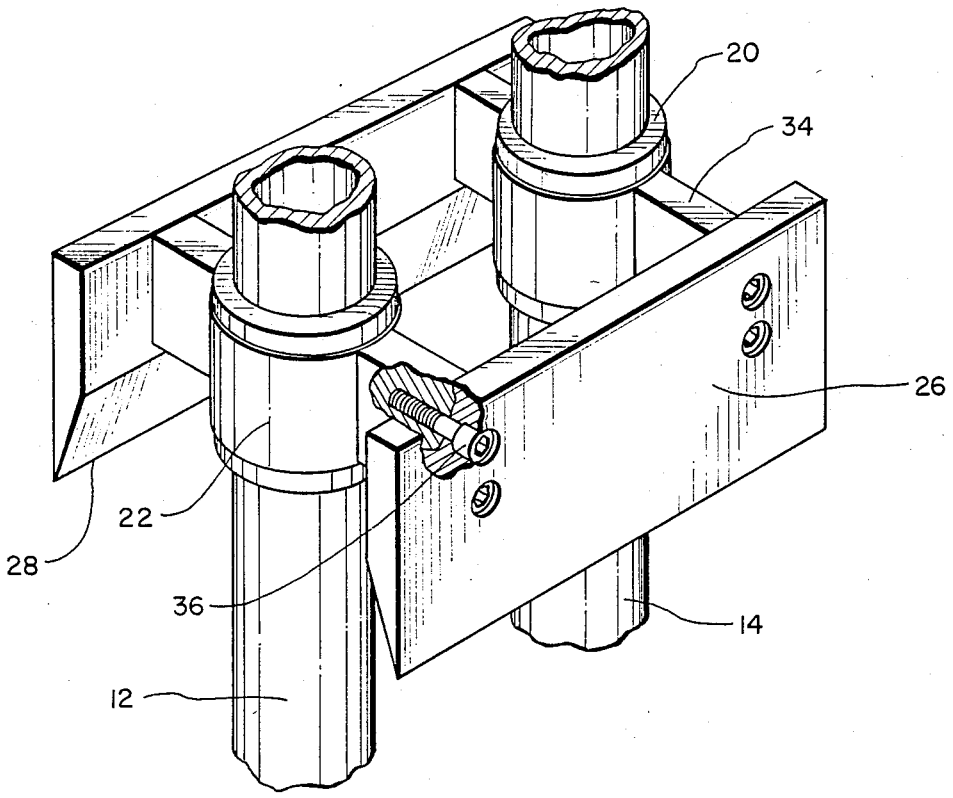
FIG. 12 is a perspective view of another preferred embodiment of the present invention.

As best shown in FIG. 12, side cutting blades 26 may be removably attached to supporting arms 34. Bolts 36 secure the cutting blades to the supporting arms such that the side cutting blades may be removed, repaired, or replaced as needed. Depending on the soil conditions, one set of cutting blades may need to be replaced at regular periodic intervals. In addition, another set of side cutting blades having a different configuration (such as illustrated in FIGS. 9, 10, and 11) may be readily substituted as needed for different situations.

It will be appreciated from FIG. 11 that the side cutting blades of the present invention themselves can serve as the stabilizer bar in maintaining proper shaft spacing and alignment.

A two-shaft auger machine equipped with side cutting blades is ideally suited for constructing continuous wall formations in situ. While surface obstructions on the ground need to be removed prior to boring the columns (which form the continuous wall), with the multi-shaft auger machine, there is no need to excavate or remove substantial portions of the soil in order to form the wall.

Because the soil at the site of installation is used as an aggregate component material to be mixed with the cement milk in the construction of the walls, its quality has a direct bearing on the quality of the continuous wall formed according to the methods of the present invention. For this reason, rubble, abandoned pipes, pieces of concrete, and other obstructions in the ground must be completely removed and replaced with good quality soil or aggregates. Suitable soil may consist of any ground composition capable of being mixed with a chemical hardener to create barrier walls or support columns or piles. Sandy, clay, silty or rocky compositions are examples of suitable soil compositions.

It will be appreciated that some excess soil is created during the construction process of the present invention. Hence, it is desirable to construct a small trench in which the excess soil can be placed. After the trench is excavated, a template is preferably used to mark each column's center on the edge of the trench, thereby making it possible to install the overlapped columns accurately. A satisfactory template may consist of a concrete guide wall or simply a steel I-beam. The template assists in establishing the center of the continuous wall and the layout of the individual wall elements. The template further facilitates horizontal and vertical alignment of the wall's center.

After the machine alignment is checked, the auger machine starts to penetrate downwardly through the soil. The process of penetrating downwardly is often referred to as an augering stroke. As the auger blades move down to the predetermined depth, the injection of cement milk through the auger shaft is initiated. As the cement milk exits the auger shaft, it is mixed with the soil by the auger blades and mixing paddles along the length of each auger. The resulting soil and cement milk mixture is referred to as a column or borehole. The use of the term "borehole" does not mean soil is removed to create a hole. Moreover, use of the term column may refer to a single in situ column formation or it may generically refer to wall formations or continuous large-area soil formations.

The mixing ratio of the cement milk to the soil is determined on the basis of the soil conditions which are determined and reported prior to boring the columns. The soil-cement mixing ratio is not decided just on the basis of the strength conditions of the continuous wall, but such factors as the soil condition and the state of ground water are also taken into consideration in order to obtain a mixing ratio which will result in a substantially homogeneous wall which has the desired strength and integrity.

Cement milk continues to be pumped through the shaft and mixed with the soil as the augers are withdrawn from the borehole. About sixty percent to eighty percent of the slurry is injected as the augers penetrate downward and the remainder is injected as they are withdrawn so that the mixing process is repeated on the way out. Auger speed and slurry output quantities are set to meet the soil conditions of the site.

Additional reinforcing members such as steel rod or steel I-beams may be embedded into the columns immediately after the augers are withdrawn; this reinforcing is particularly useful in boundary walls which are used to contain materials or in walls which require additional structural strength.

Figure 17:
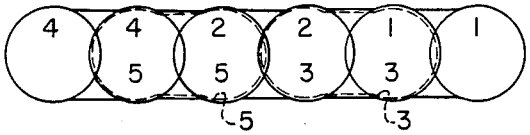
FIG. 17 is a view illustrating one augering stroke sequence which may be employed to construct continuous soilcrete walls.
Figure 18:
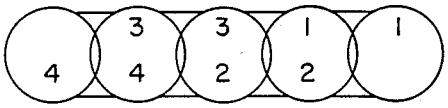
FIG. 18 is a view illustrating an alternative augering stroke sequence which may be employed to construct continuous soilcrete walls.

Continuous soilcrete walls are constructed by linking sets of columns formed in a sequence of augering strokes. FIGS. 17 and 18 illustrate two alternative augering stroke sequences for constructing continuous soilcrete walls. As shown in FIG. 17, after the first augering stroke, two soilcrete columns are formed each numbered as column 1. The multi-shaft auger machine is advanced horizontally such that the first shaft is positioned adjacent to the column previously formed by the second shaft. The second augering stroke forms two more soilcrete columns each numbered as column 2. The multi-shaft auger machine is then moved to a position such that the first shaft is positioned over columns formed during the first and second strokes. The third augering stroke joins the previously formed columns into a continuous wall formation. Columns formed during the third augering stroke are numbered as column 3. The process is repeated until the desired wall formation is complete.

Figure 13:
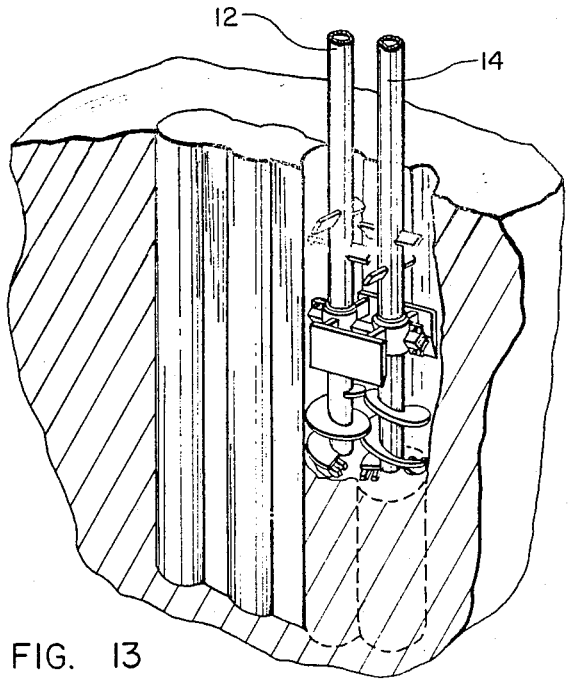
FIG. 13 is a partial cut away perspective view illustrating an embodiment within the scope of the present invention in the process of augering a continuous soilcrete wall.

FIG. 18 illustrates an alternative method of forming continuous soilcrete walls. After the first augering stroke, two columns are formed each numbered as column 1. The multi-shaft auger machine is advanced horizontally to the position for the second augering stroke such that the first shaft is centered over the column previously formed by the second shaft. Columns formed during the second and succeeding augering strokes are numbered accordingly. Thus, the previous stroke always serves as a guide for the next stroke. This feature is also illustrated in FIG. 13, wherein first shaft 12 is using a previously formed column as a guide hole. This procedure not only guarantees the construction of complete, continuous columns, but also thoroughly mixes the soil with the cement milk throughout the length of the continuous wall.

The stroke sequence illustrated in FIG. 18 may not be suitable in soil conditions which are hard and rocky. In hard soil, the auger shafts will tend to deviate into the area of least resistance which would consist of a freshly bored adjacent column. In such cases it would be preferable to use the stroke sequence illustrated in FIG. 17.

These construction methods of the present invention solve several of the problems encountered in the prior art methods. The stability of the soil is never endangered because the soil is not excavated or removed from the borehole. The soil mixes in situ with the cement milk in order to form the continuous wall. This method eliminates the need for many emergency provisions because there is never an "open hole." Even if there is a major breakdown of the equipment or a power loss, the hole is never "open."

Safety is also enhanced by not having an open excavation. Only a small portion of the wall (one stoke) is being worked on at any one time, and this area is completely full of material. In addition, very little material is brought to the surface; any soil and mixture which is brought to the surface can be quickly and easily removed. There is no need for ponds, panels, or large quantities of fluid slurry present at any time, so the risk of a significant slurry spill is totally eliminated.

The chemical hardener or cement milk composition varies depending upon the soil composition and the intended use of the soilcrete columns. In nearly all cases, the chemical hardener contains a cement or a cement substitute. Generically, chemical hardener or cement milk refers to anything mixed with soil to form a hardened column.

Quite often the cement milk also contains bentonite. Bentonite is added to make the wall water impervious or to give a wall or column high strength. If a continuous wall is to be built along a riverside or some other body of water, then bentonite will preferably be a primary additive so that the resultant wall will allow minimum water seepage through the wall. Bentonite may also be added to the cement milk when the soil is sandy or granular in order to provide an effective aggregate material with which to mix the slurry fluids.

If the column is to be constructed next to a prexisting wall, then fiber may be added to the cement milk composition. Fiber, in the form of cotton fibers or even lignin from sources such as soybeans, absorbs water and expands; thus, the new soilcrete wall will form a tight seal with the prexisting wall. Other additives, such as "CMC" paste or asphalt emulsions may be added to the cement milk to give the resulting wall additional watertight characteristics.

Typically the cement milk to be pumped into the borehole is made in a grout plant adjacent to the construction site. The cement milk is pumped to the top of the auger shafts while the auger machine is in operation. It is particularly important to provide constant cement milk pressure and flow rate to each shaft of the multi-shaft auger machine in order to obtain a homogeneous mixture of the cement milk and the soil and to obtain a wall without weak sites. If one shaft receives more cement milk than the other shafts, nonhomogeneous columns will result.

The soil mixing paddles and auger blades along the length of the auger machine shafts are constructed of a high quality weldable steel. It is important that the paddles and blades be constructed of a material which can be welded at the construction site since the equipment must be readily repairable. In addition, since the soil will necessarily vary in consistency and periodically contain rock formations, the auger blades and mixing paddles will encounter significant stress and occasionally break. If the mixing paddles and auger blades must be removed from the construction site to be repaired, significant construction delays could be anticipated. The auger teeth located at the bottom of each shaft are preferably constructed out of a high quality hardened steel because of the stresses encountered.

Figure 14:
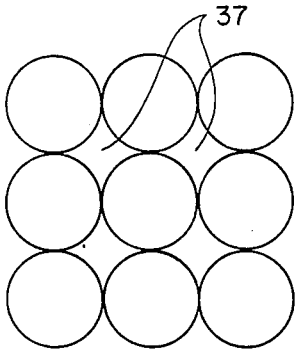
FIG. 14 is a view illustrating the cross-sectional interstitial spaces between columns created by a two-shaft auger machine without overlap or offset of adjacent columns.

A two-shaft auger machine equipped with cutting blades is also ideally suited for constructing continuous large-area columns or piles. Such columns are constructed by overlapping and offsetting a few parallel soilcrete wall formations. Without the side cutting blades of the present invention, a two-shaft auger machine would construct a large-area column with numerous interstitial spaces 37 as shown in FIG. 14. It is necessary to fill these interstitial spaces or the columns will have areas of significant weakness. The presence of interstitial spaces makes the large-area formation discontinuous.

Figure 15:
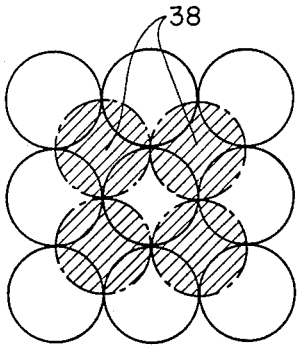
FIG. 15 is a view of the configuration of FIG. 13 illustrating the need to auger additional columns in order to eliminate the interstitial spaces between adjacent columns.
Figure 16:
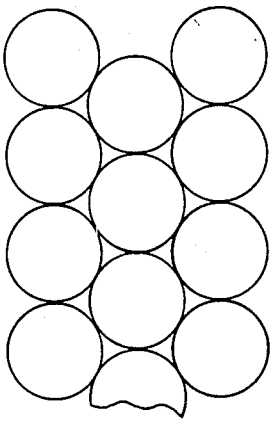
FIG. 16 is a view illustrating the cross-sectional interstitial spaces between adjacent columns created by a two-shaft auger machine with offset of the columns.

These interstitial spaces may be eliminated by boring additional soilcrete columns 38 as shown in FIG. 15. Alternatively, the soilcrete columns can be offset as illustrated in FIG. 16. By offsetting the columns, the size of the interstitial spaces between the columns is significantly reduced. Nevertheless, in order to eliminate the interstitial spaces, either substantial column overlap or additional boring is required using the methods of the prior art.

Figure 19:
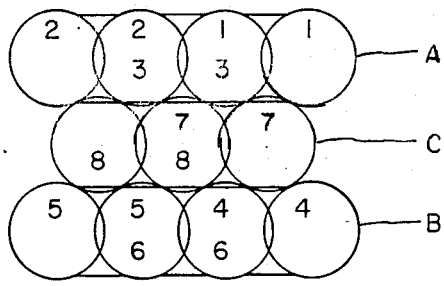
FIG. 19 is a view illustrating one augering stroke sequence which may be employed by a two-shaft auger machine with side cutting blades to produce overlapping and offset parallel soilcrete wall formations without interstitial spaces between adjacent columns.

FIG. 19 illustrates that offset columns produced by a two-shaft auger machine equipped with cutting blades do not possess interstitial spaces between the columns. Thus, continuous, large-area columns may be constructed quickly and efficiently by using a two-shaft auger machine equipped with the side cutting blades of the present invention.

A stroke sequence for constructing continuous large-area columns is also illustrated in FIG. 19. As discussed above, continuous large-area columns may be constructed by combining a series of parallel wall formations. Thus, the alternative stroke sequences for constructing continuous wall formations discussed above and illustrated in FIGS. 17 and 18 may be used in constructing continuous, large-area columns.

As shown in FIG. 19, a first wall is constructed labeled A. The multi-shaft auger machine is then moved in order to construct a second wall parallel to the first wall and labeled B. A third wall, labeled C, is formed between walls A and B. Wall C is slightly offset and slightly overlaps walls A and B. Additional parallel walls may be constructed as described above in order to form the desired continuous, large-area columns.

Continuous, large-area columns are particularly useful in soil fixation techniques. For example, soil which is contaminated with toxic or hazardous waste may be blended with a chemical hardner in situ. Upon hardening, the contaminants are permanently immobilized in situ and will not migrate into the watertable or spread onto uncontaminated surroundings. Furthermore, the contaminated soil may be treated without excavation or the risk of exposing workers to harmful contaminants.

A multi-shaft auger machine equipped with cutting blades is particularly useful in constructing soil or foundation improvement projects as a honeycomb-like structure to improve the load-bearing capacity of the soil. Referring generally to FIGS. 20–23, individual soilcrete wall formations may be combined and arranged to form various geometric patterns which improve the load-bearing capacity of the soil.

Figure 20:
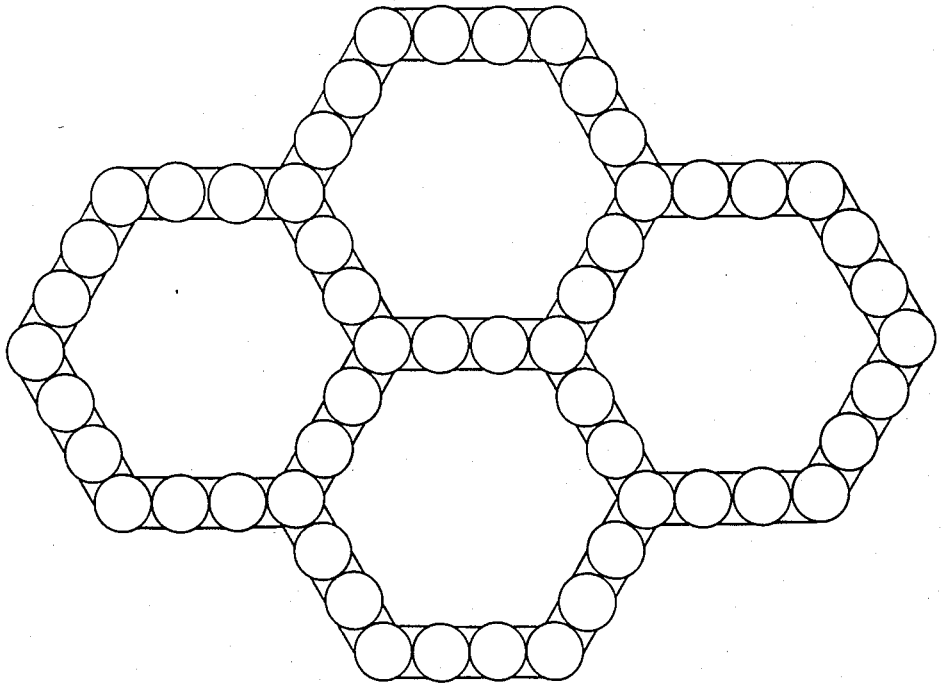
FIG. 20 is a view illustrating a number of soilcrete wall formations arranged in a honeycomb-like configuration.
Figure 21:
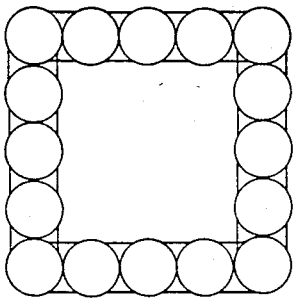
FIG. 21 is a view illustrating a number of soilcrete wall formations arranged in a square configuration.
Figure 23:
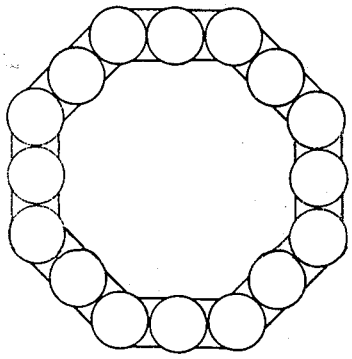
FIG. 23 is a view illustrating a number of soilcrete wall formations arranged in an octagonal configuration.
Figure 22:
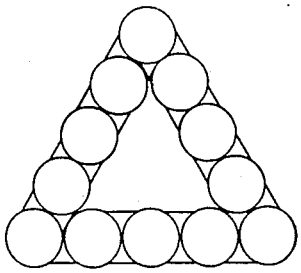
FIG. 22 is a view illustrating a number of soilcrete wall formations arranged in a triangular configuration.

FIG. 20 illustrates a group of hexagonal configurations which have been combined to form a honeycomb-like structure. Other geometric patterns such as a square as illustrated in FIG. 21, a triangle as illustrated in FIG. 22, or an octagon as illustrated in FIG. 23 may be constructed singularly or in combination to improve the load-bearing capacity of the soil. These polygonal configurations are particularly useful in soil which is susceptible to liquification during an earthquake, thereby enabling buildings, oil tanks, or other structures to be constructed on an earthquake resistant foundation.

From the foregoing, it will be appreciated that the present invention provides apparatus and methods for forming soilcrete columns, walls, and piles which permit effective overlap between adjacent columns without sacrificing column diameter or requiring additional boring strokes or larger power requirements in order to drive larger augers. This is accomplished by providing parallel side cutting blades which cut the soil between the adjacent columns so that such soil is mixed with cement milk and forms a portion of the adjacent columns. In this way, the present invention improves soil/cement milk mixing over a larger area and in less time than existing soil-mixing techniques.

Additionally, it will be appreciated that the present invention provides apparatus and methods for forming soilcrete columns, walls, and piles which may be overlapped in series to form a larger diameter continuous soilcrete wall without requiring additional power. This is accomplished because a two-shaft auger machine may inherently construct larger diameter columns than a three-shaft auger machine using the same amount of power.

Likewise, it will be appreciated that the present invention provides apparatus and methods for forming soilcrete columns, walls, and piles with increased effective overlap between the adjacent columns, thereby providing improved soil stabilization and foundational support capabilities. In addition, the present invention permits efficient construction of continuous large-volume columns without creating interstitial voids and without requiring substantial column overlap.

It will also be appreciated that the present invention provides versatile apparatus and methods for forming soilcrete columns, walls, and piles wherein the same equipment may be used to construct different types of columns, walls, and piles. Additionally, the present invention permits the formation of soilcrete columns, walls, and piles possessing a homogeneous blend of soil and chemical hardener without increasing the construction time, the overall cost, and the amount of materials consumed. Because the present invention permits the formation of soilcrete columns, walls, and piles having a homogenous blend of soil and chemical hardener, the adjacent columns possess substantially equal strength, density, and integrity properties.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for in situ formation of a hardened soilcrete column in soil using a multi-shaft auger apparatus, the method comprising the steps of:

(a) augering at least two boreholes downwardly into and through the soil with the multi-shaft auger apparatus such that the boreholes are adjacent and have a cross-sectional geometric configuration with minimal overlap of the adjacent boreholes, the centers of the boreholes defining a geometric soil mixing plane;

(b) injecting a chemical hardener into the soil during the augering of the boreholes;

(c) cutting the soil with at least two cutting blades attached to the multi-shaft auger apparatus along planes approximately parallel to the soil mixing plane such that the adjacent boreholes form a single column having a minimum thickness approximately equal to the diameter of the smallest borehole;

(d) blending the soil within the column with the chemical hardener; and (e) allowing the soil and chemical hardener blend to cure to form a hardened soilcrete column.

2. A method for in situ formation of a hardened soilcrete column in soil using a multi-shaft auger apparatus as defined in claim 1, wherein the chemical hardener injected into the soil includes a cement product.

3. A method for forming in situ a hardened soilcrete column in soil using a multi-shaft auger apparatus as defined in claim 1, wherein the chemical hardener injected into the soil includes bentonite.

4. A method for forming in situ a hardened soilcrete column in soil using a multi-shaft auger apparatus as defined in claim 1, wherein the chemical hardener injected into the soil includes a fibrous material capable of absorbing water.

5. A method for forming in situ a hardened soilcrete column in soil using a multi-shaft auger apparatus as defined in claim 1, further comprising the step of withdrawing the multi-shaft auger apparatus from the borehole while simultaneously blending the soil within the column with the chemical hardener.

6. A method for forming in situ a hardened soilcrete column in soil using a multi-shaft auger apparatus as defined in claim 1, further comprising the step of inserting at least one rod member into the column in order to reinforce the soilcrete column prior to allowing the soil hardener mixture to cure.

7. A method for forming in situ a hardened soilcrete column in soil using a multi-shaft auger apparatus as defined in claim 6, wherein at least one metal rod member is inserted vertically into each of the boreholes comprising the column in order to reinforce the soilcrete column.

8. A method for in situ construction of a hardened soilcrete wall in soil using a multi-shaft auger apparatus, the method comprising the steps of:

(a) augering at least two boreholes downwardly into and through the soil with an auger apparatus having a plurality of substantially parallel, vertical, and coplanar shafts such that the boreholes are adjacent and have a cross-sectional geometric configuration with minimal overlap of the adjacent boreholes, the centers of the boreholes defining a geometric soil mixing plane;

(b) injecting a chemical hardener into the soil during the augering of the boreholes;

(c) cutting the soil with at least two cutting blades attached to the multi-shaft auger apparatus along planes approximately parallel to the soil mixing plane such that the adjacent boreholes form a single column having a minimum thickness approximately equal to the diameter of the smallest borehole;

(d) blending the soil within the first column with the chemical hardener to form a soil/hardener mixture;

(e) withdrawing the multi-shaft auger apparatus from the column of soil/hardener mixture;

(f) moving the multi-shaft auger apparatus to a position such that one of the shafts of the multi-shaft auger apparatus is positioned over a previously augered borehole;

(g) sequentially repeating steps (a) through (e) such that the newly augered borehole forms a portion of the existing column of soil/hardener mixture, thereby constructing a wall having a minimum thickness approximately equal to the diameter of the smallest augered borehole; and (h) allowing the soil and chemical hardener blend to cure to form a hardened soilcrete wall.

9. A method for in situ construction of a hardened soilcrete wall in soil using a multi-shaft auger apparatus as defined in claim 8, wherein the chemical hardener injected into the soil includes a cement product.

10. A method for in situ construction of a hardened soilcrete wall in soil using a multi-shaft auger apparatus as defined in claim 8, wherein the chemical hardener injected into the soil includes bentonite.

11. A method for in situ construction of a hardened soilcrete wall in soil using a multi-shaft auger apparatus as defined in claim 8, wherein the chemical hardener injected into the soil includes a fibrous material capable of absorbing water.

12. A method for in situ construction of a hardened soilcrete wall in soil using a multi-shaft auger apparatus as defined in claim 8, further comprising the step of inserting, prior to allowing the soil/hardener mixture to cure, at least one rod member into the column in order to reinforce the soilcrete wall.

13. A method for in situ construction of a hardened soilcrete wall in soil using a multi-shaft auger apparatus as defined in claim 12, wherein at least one metal rod member is inserted vertically into each of the boreholes comprising the wall in order to reinforce the soilcrete wall.

14. A method for in situ construction of a hardened soilcrete wall in soil using a multi-shaft auger apparatus as defined in claim 8, wherein the multi-shaft auger apparatus is sequentially moved according to step (e) such that the cross-section of the soilcrete wall is in the shape of a polygon.

15. A method for in situ construction of a hardened soilcrete wall in soil using a multi-shaft auger apparatus as defined in claim 14, wherein the polygonal cross-sectional shape of the soilcrete wall is a triangle.

16. A method for in situ construction of a hardened soilcrete wall in soil using a multi-shaft auger apparatus as defined in claim 14, wherein the polygonal cross-sectional shape of the soilcrete wall is a hexagon.

17. A method for in situ construction of a hardened soilcrete wall in soil using a multi-shaft auger apparatus as defined in claim 14, further comprising the step of constructing a series of connected soilcrete walls having a polygonal cross-section so as to form a honeycomb-like structure.

18. A method for in situ construction of a hardened soilcrete wall in soil using a multi-shaft auger apparatus as defined in claim 16, further comprising the step of constructing a series of connected soilcrete walls having a hexagonal cross-section so as to form a honeycomb-like structure.

19. A method for in situ construction of a hardened soilcrete wall in soil using a two-shaft auger apparatus, the method comprising the steps of:

(a) augering a first borehole and a second borehole downwardly into and through the soil with the first shaft and the second shaft, respectively, of the two-shaft auger apparatus such that the first and second boreholes are adjacent, the centers of the first and second boreholes defining a geometric soil mixing plane;

(b) injecting a chemical hardener into the soil during the augering of the first and second boreholes;

(c) blending the soil within the first and second boreholes with the chemical hardener to form a soil/-hardener mixture;

(d) withdrawing the two-shaft auger apparatus from the first and second boreholes;

(e) moving the two-shaft auger apparatus such that the first auger is adjacent to the second borehole;

(f) augering a third borehole and a fourth borehole downwardly into and through the soil with the first shaft and the second shaft, respectively, of the two-shaft auger apparatus such that the third borehole is adjacent to the second borehole;

(g) injecting a chemical hardener into the soil with the third and fourth boreholes during augering step (f);

(h) blending the soil within the third and fourth boreholes with the chemical hardener to form a soil/-hardener mixture;

(i) withdrawing the two-shaft auger apparatus from the third and fourth boreholes;

(j) moving the two-shaft auger apparatus such that the first shaft is positioned over the second borehole and the second shaft is positioned over the third borehole;

(k) reaugering the second borehole with the first shaft and the third borehole with the second shaft, respectively, such that the first, second, third, and fourth boreholes form a wall of soil/hardener mixture;

(l) withdrawing the two-shaft auger apparatus from the second and third boreholes;

(m) allowing the soil/hardener mixture to cure to form a hardened soilcrete wall.

20. A method for in situ construction of a hardened soilcrete wall in soil using a multi-shaft auger apparatus as defined in claim 18, further comprising the steps of sequentially repeating the moving, augering, injecting, blending, and withdrawing steps (e) through (i) in the soil adjacent the last augered borehole such that the newly augered boreholes add to the existing wall of soil-hardener mixture.

21. A method for in situ construction of a hardened soilcrete wall in soil using a multi-shaft auger apparatus as defined in claim 19, further comprising the step of cutting the soil with at least two cutting blades attached to the multi-shaft auger apparatus along planes approximately parallel to the soil mixing plane during each augering step such that adjacent boreholes substantially form a single column, thereby the constructed wall having a minimum thickness approximately equal to the diameter of the smallest borehole.

22. A method for in situ construction of a hardened soilcrete wall in soil using a multi-shaft auger apparatus as defined in claim 19, wherein the chemical hardener injected into the soil includes a cement product.

23. A method for in situ construction of a hardened soilcrete wall in soil using a multi-shaft auger apparatus as defined in claim 20, wherein the chemical hardener injected into the soil includes bentonite.

24. A method for in situ construction of a hardened soilcrete wall in soil using a multi-shaft auger apparatus as defined in claim 20, wherein the chemical hardener injected into the soil includes a fibrous material capable of absorbing water.

25. A method for in situ construction of a hardened soilcrete wall in soil using a multi-shaft auger apparatus as defined in claim 20, further comprising the step of inserting, prior to allowing the soil/hardener mixture to cure, at least one rod member into the column in order to reinforce the soilcrete wall.

26. A method for in situ construction of a hardened soilcrete wall in soil using a multi-shaft auger apparatus as defined in claim 25, wherein at least one metal rod member is inserted vertically into each of the boreholes comprising the wall in order to reinforce the soilcrete wall.

27. A method for in situ construction of a hardened soilcrete wall in soil using a multi-shaft auger apparatus as defined in claim 20, wherein the multi-shaft auger apparatus is sequentially moved according to step (e) such that the cross-section of the soilcrete wall is in the shape of a polygon.

28. A method for in situ construction of a hardened soilcrete wall in soil using a multi-shaft auger apparatus as defined in claim 27, wherein the polygonal cross-sectional shape of the soilcrete is a triangle.

29. A method for in situ construction of a hardened soilcrete wall in soil using a multi-shaft auger apparatus as defined in claim 27, wherein the polygonal cross-sectional shape of the soilcrete wall is a hexagon.

30. A method for in situ construction of a hardened soilcrete wall in soil using a multi-shaft auger apparatus as defined in claim 27, further comprising the step of constructing a series of connected soilcrete walls having a polygonal cross-section so as to form a honeycomb-like structure.

31. A method for in situ construction of a hardened soilcrete wall in soil using a multi-shaft auger apparatus as defined in claim 29, further comprising the step of constructing a series of connected soilcrete walls having a hexagonal cross-section so as to form a honeycomb-like structure.

32. A method for in situ construction of a hardened soilcrete wall in soil using a multi-shaft auger apparatus as defined in claim 20, further comprising the steps of sequentially repeating the moving, augering, injecting, blending, and withdrawing steps (e) through (i) in the soil adjacent the previously augered boreholes along a second geometric soil mixing plane which is parallel to the first geometric soil mixing plane of the previously augered boreholes, said second geometric soil mixing plane being distanced from the first geometric soil mixing plane such that the interstitial spaces between the boreholes are minimized and such that substantially all of the soil between the boreholes is blended with the chemical hardener.

* * * * *

UNITED STATES PATENT AND TRADEMARK OFFICE

CERTIFICATE OF CORRECTION

PATENT NO. : 4,906,142

DATED : March 6, 1990

INVENTOR(S) : OSAMU TAKI et al.

It is certified that error appears in the above-identified patent and that said Letters Patent is hereby corrected as shown below:

Column 2, line 20, delete second occurrence of "column"
Column 4, line 3, "verstility" should be --versatility--
Column 7, line 56, "breakup" should be --break up--
Column 7, line 59, "breakup" should be --break up--
Column 8, line 11, "allows" should be --allow--
Column 9, line 30, "tangent" should be --tangential--
Column 13, line 42, after "constructed" insert --and--

Signed and Sealed this

Fourteenth Day of July, 1992

*Attest:*

DOUGLAS B. COMER

*Attesting Officer*

*Acting Commissioner of Patents and Trademarks*